United States Patent [19]

Hruban

[11] Patent Number: 4,506,398

[45] Date of Patent: Mar. 26, 1985

[54] WATER BED SHEET

[76] Inventor: Mark Hruban, Eight S. 114 Vine St., Hinsdale, Ill. 60521

[21] Appl. No.: 535,438

[22] Filed: Sep. 26, 1983

[51] Int. Cl.[3] ..... A47C 27/08; A47G 9/02

[52] U.S. Cl. ..... 5/451; 5/498

[58] Field of Search ..... 5/451, 452, 482, 485, 5/487, 495, 496, 497, 498

[56] References Cited

U.S. PATENT DOCUMENTS

| | | | |
|---|---|---|---|
| 2,896,226 | 7/1959 | Swicegood et al. | 5/498 |
| 4,045,832 | 9/1977 | Diforti et al. | 5/496 |
| 4,100,632 | 7/1978 | Johnson | 5/498 |
| 4,228,555 | 10/1980 | Katzakian | 5/451 |

FOREIGN PATENT DOCUMENTS

| | | | |
|---|---|---|---|
| 1342957 | 10/1963 | France | 5/407 |

*Primary Examiner*—Alexander Grosz

*Attorney, Agent, or Firm*—Dressler, Goldsmith, Shore, Sutker & Milnamow, Ltd.

[57] ABSTRACT

A bed sheet for water beds which is substantially rectangular in configuration and dimensioned to cover the top of the fluid-filled mattress. Integral extensions project from the four sides of the sheet and are adapted to be draped over the mattress and positioned between the mattress and the rigid walls of the bed frame. A hemmed pocket is stitched onto each extension and rigid rod means are insertable into said pockets so that, when operationally positioned, the mattress cooperates with the rigid walls of the bed frame to positively grip the rod means therebetween.

7 Claims, 4 Drawing Figures

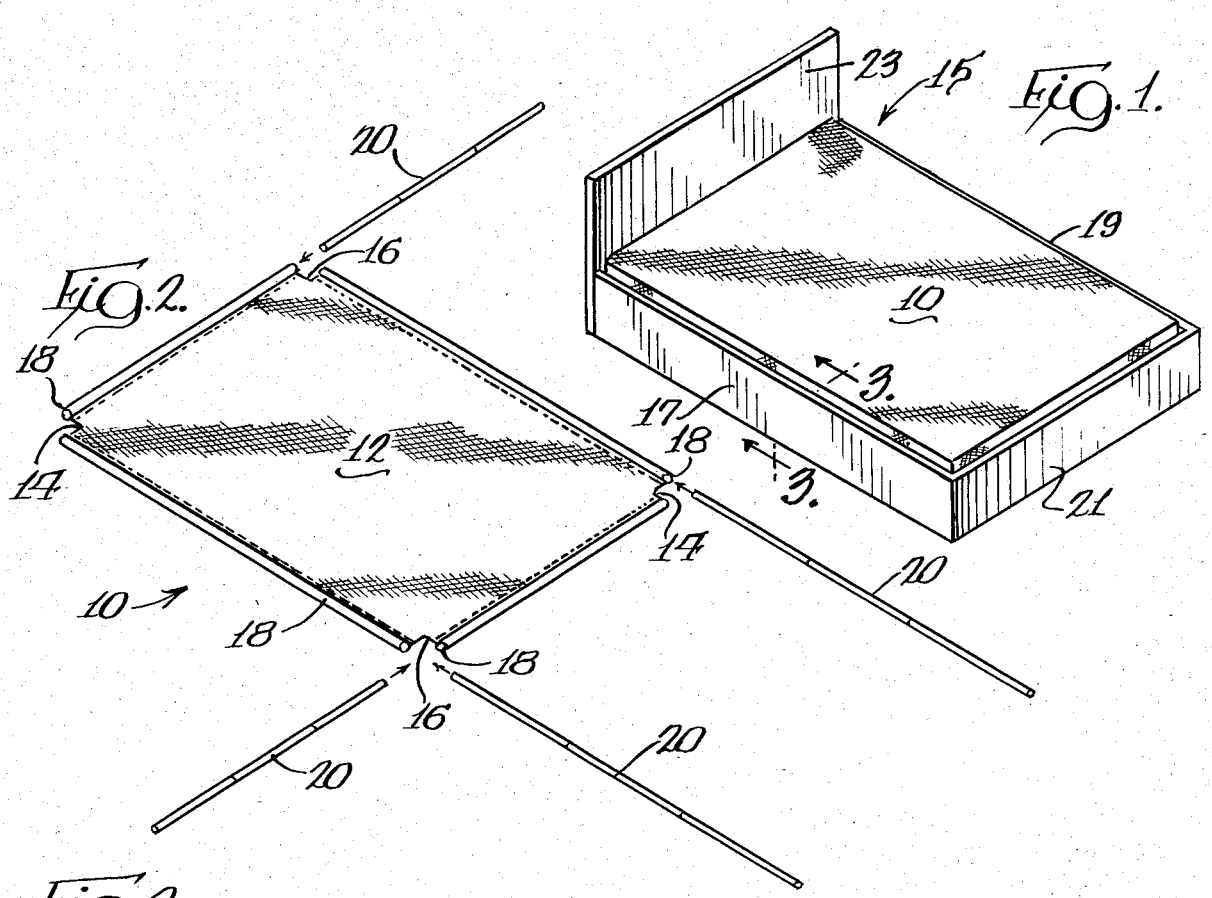
Fig. 1.
Fig. 2.
23
15
19
10
3.
17
18
21
20
16
12
14
10
18
16
20
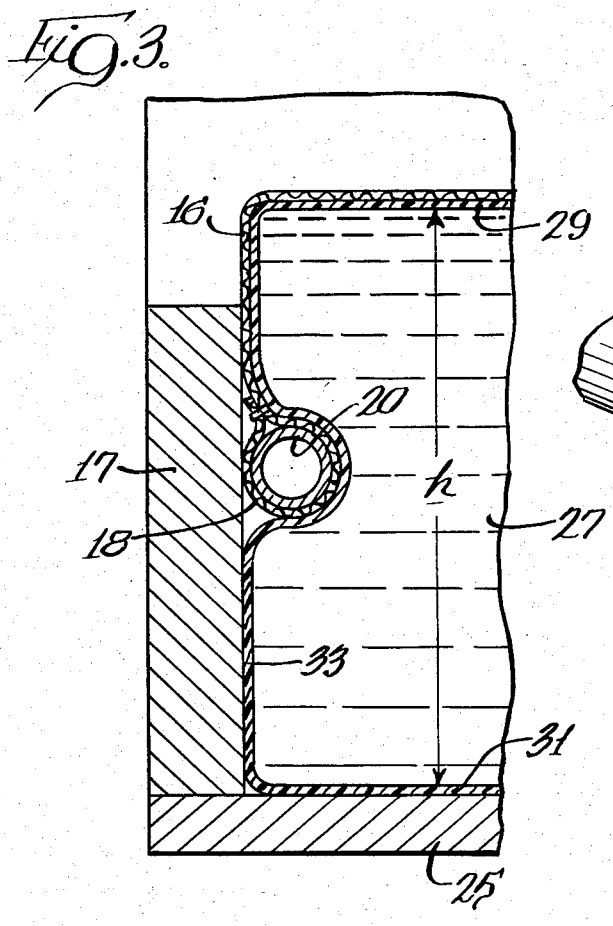
Fig. 3.
16
29
20
17
h
18
27
33
31
25
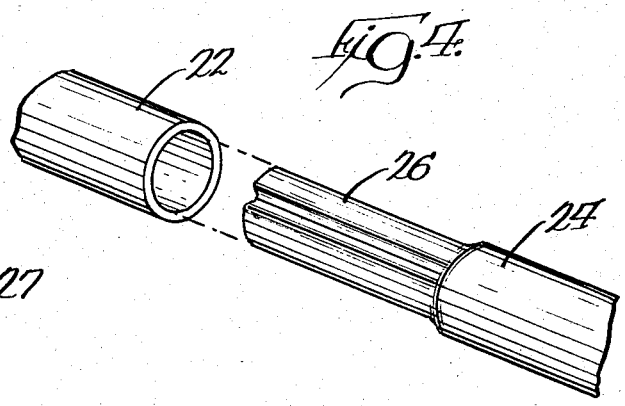
Fig. 4.
22
26
24

WATER BED SHEET

BACKGROUND OF THE INVENTION

This invention relates to bed sheets for water beds and, more particularly, to a water bed sheet having self-contained means for retaining the sheet in operational position on the fluid-filled bladder.

The use and operational positioning and retention of bedding and bed sheets, both on conventional mattresses and fluid-filled mattresses, presents the type of annoying problems that still await satisfactory solution. Prior efforts to solve the problems with relation to the older, conventional mattresses may be seen in U.S. Pat. Nos. 739,682; 1,297,551; 2,507,091; 3,606,622; and 4,100,632.

With the fairly recent advent of the water bed, there have arisen bedding problems of even greater complexity. Those skilled in the art will, of course, appreciate that the plastic or flexible character of a fluid-filled mattress vitiates some of the earlier devices that might have proved relatively effective with the more rigid conventional mattress. Representative of the problems encountered with water beds are described in U.S. Pat. Nos. 4,228,555 and 4,279,061.

The complexity and magnitude of the problems encountered with water beds is perhaps best appreciated from an examination of the aforementioned Pat. No. 4,228,555. That reference teaches a complicated folding frame structure which is separate and apart from the water bed. A pad which is designed to be positioned between the occupant and the fluid-filled bladder is connected to the frame with marginal edge hook and loop type fasteners or the like. The top sheet has hemmed pockets on three sides into which the pivotal members of the frame structure are inserted and that sheet, which is double length, is folded back toward the head of the bed. The entire frame thus attired is positioned over the bladder and rests on the bed frame.

Despite the sophistication and complexity of the described patented bed sheet frame, the shortcomings attendant the use of that structure are apparent. Thus, for example, the "making" of the bed is complicated and difficult. With a frame structure most likely made of metal rods, there exists the danger of damage to the fluid bladder. Similarly, there exists the danger of injury to the occupant who could roll over against the frame structure. The sheets, and particularly the top sheet, are of such unusual form and dimensions that special laundering processes are probably required. Finally, there is the obvious expense of the frame structure and highly specialized sheets.

There thus exists a need for a water bed sheet which is inexpensive, has self-retaining means, is simple to use, and is of generally conventional configuration so that special laundering and maintenance measures are not required.

SUMMARY OF THE INVENTION

The present invention provides a water bed sheet which actually takes advantage of the plastic nature of the fluid-filled bladder and utilizes the same to retain the sheet in operational position. The inventive bed sheet is of generally conventional rectangular configuration and, if anything, of smaller dimensions than most conventional sheets. Rigid means is provided for insertion into the perimetral sides of the sheet and are designed to drape over the bladder sidewalls to a position intermediate the height of said sidewalls. The bladder sidewalls thereupon cooperate with the walls of the bed frame to firmly grip the rigid means therebetween and prevent movement of migration of the sheet.

Other features and advantages of the invention will be apparent from the following description and claims and are illustrated in the accompanying drawings which show structure embodying preferred features of the present invention and the principles thereof.

BRIEF DESCRIPTION OF THE DRAWINGS

FIG. 1 is a perspective view of a water bed with a bed sheet embodying the principles of the invention operationally positioned thereon;

FIG. 2 is an exploded perspective view of a bed sheet alone;

FIG. 3 is an enlarged sectional view taken on the plane of line 3—3 in FIG. 1; and FIG. 4 is an enlarged perspective view illustrating a separable, multi-section construction of the rod members.

DETAILED DESCRIPTION OF THE INVENTION

Referring with greater particularity to the various figures of the drawings, it will be seen that the reference character 10 indicates generally a water bed sheet embodying the principles of the invention. In FIG. 1, bed sheet 10 is illustrated as operationally positioned on a water bed 15 which is of conventional construction. Water bed 15 thus comprises a bed frame enclosure formed by sidewalls 17 and 19, a bottom wall 21, a headboard wall 23 and a baseboard wall 25. A fluid-filled mattress or bladder 27 is conventionally received in the bed frame enclosure and is supported by the baseboard wall 25.

In general, the bladder 27 comprises a pliable, fluid-tight member having a top wall 29 and a bottom wall 31 interconnected by a vertical sidewall 33. When filled with a fluid and operationally positioned in the bed frame, the sidewall 33 assumes a vertical height h and bears against the walls 17, 19, 21 and 23 of the bed frame (see FIG. 3).

Bed sheet 10 comprises a rectangular cover portion 12 which is of substantially the same dimensions as the top and bottom walls of the bladder 27. Integrally projecting from the cover portion 12 are lateral extensions 14, 14 and end extensions 16, 16. Each of the extensions 14 and 16 has formed at the extremity thereof a hemmed pocket 18 which may be formed by well-known methods such as stitching. It is important to note that the sheet extensions 14 and 16 have a dimension which is somewhat less than the height h of the sidewall of the bladder and, preferably, in a range of from 25% to 75% of said height h. Accordingly, when the sheet 10 is operationally positioned and draped over the bladder 27, the pockets 18 are positioned at a medial point of the sidewall height h, preferably around the approximate mid-point thereof (see FIG. 3).

Elongated, rigid means such as rods 20 are insertable into the pockets 18. For purposes of ease of shipment, storage and adjustable sizing, the rods 30 may comprise separable rod sections 22 and 24 having telescoping means 26 for releasable connection therebetween. Alternately, solid rod sections may be used, which are releasably connected in end-to-end relationship by a tubular sleeve. Other forms of connectors, such as bayonet arrangements, may likewise be employed.

Operation of the bed sheet 10 may now be best appreciated with reference to FIG. 3 of the drawings. To make the bed 15, a rod 20 of suitable length is inserted into each of the pockets 18 and the sheet is positioned centrally on the bladder 27. The extensions 14 and 16 are then draped over the blader and each of the rods 20 pressed between the bladder and the sidewall of the bed frame. Owing to the outward pressure force of the contained fluid and the plasticity of the bladder material, the bladder sidewall 33 thereupon cooperates with the associated bed frame sidewall to firmly grip the rod 20 therebetween. Moreover, the effectiveness of that gripping cooperation is enhanced because the bladder sidewall is indented and deformed to substantially completely encircle the rod 20. It will likewise be appreciated that the added weight of an occupant on the bladder simply increases the outward pressure forces to make further positive the described gripping action.

Various modifications are contemplated and may obviously be resorted to by those skilled in the art without departing from the spirit and scope of the invention, as hereinafter defined by the appended claims.

What is claimed is:

1. A bed sheet for a water bed having a bed frame with rigid sidewalls and a fluid-filled bladder supported in said bed frame wherein the flexible peripheral wall of said bladder bears against said rigid sidewalls, said bed sheet comprising:

a central portion for covering the top of said bladder;

lateral and end extensions projecting from said central portion;

pocket means at the extremities of said extensions; and elongated rigid means removably inserted into said pocket means so that each inserted rigid means is independent of and disconnected from the others, whereby when said extensions are draped over said bladder the bladder peripheral wall cooperates with said rigid bed frame walls to positively grip each of said rigid means therebetween.

2. A bed sheet according to claim 1 wherein said central portion is of substantially the same dimension as the top of said bladder.

3. A bed sheet according to claim 2 wherein said extensions are integrally formed with said central portion.

4. A bed sheet according to claim 3 wherein said pocket means comprises a hemmed pocket formed by stitching on each of said extensions.

5. A bed sheet according to claim 4 wherein the length of said extensions is less than the vertical height of said bladder peripheral wall.

6. A bed sheet according to claim 4 wherein the length of said extensions is between 25% and 75% of the vertical height of said bladder peripheral wall.

7. A water bed comprising:

a rectangular bed frame having rigid vertical sidewalls;

a fluid-filled mattress having a substantially vertical peripheral wall supported in said bed frame and said peripheral wall bearing against said vertical sidewalls;

a flexible bed sheet retained by said peripheral wall and vertical sidewalls in operational mattress-covering relationship, said bed sheet comprising, a rectangular central portion covering the top of said mattress;

side extensions and end extensions projecting integrally from said central portion;

an elongated hemmed pocket formed at the extremity of each of said side and end extensions; and an elongated relatively rigid rod removably positioned in each of said pockets, each of said rods being independently of and disconnected from the others, said extensions being draped over the mattress top so that each of said rods is substantially horizontal at the approximate mid-point of its associated mattress peripheral wall, said peripheral wall and vertical sidewalls cooperating to firmly grip each of said rods therebetween.

* * * * *